United States Patent [19]

Riedel

[11] 4,326,320

[45] Apr. 27, 1982

[54] LEVER-OPERABLE FASTENER FOR A SHOE

[75] Inventor: Tilo H. Riedel, Salzburg, Austria

[73] Assignee: Sesamat Anstalt, Schaan, Liechtenstein

[21] Appl. No.: 91,986

[22] Filed: Nov. 7, 1979

[30] Foreign Application Priority Data

Nov. 15, 1978 [AT] Austria ..... A8152/78

[51] Int. Cl.[3] ..... A43C 11/00; A43B 11/00

[52] U.S. Cl. ..... 24/70 SK; 36/50

[58] Field of Search ..... 24/68 R, 68 SK, 69 R, 24/69 SK, 69 ST, 70 R, 70 SK, 70 ST, 71 R, 71 SK, 206 B; 36/50

[56] References Cited

U.S. PATENT DOCUMENTS

| | | | |
|---|---|---|---|
| 376,655 | 1/1888 | Hopkins et al. | 24/70 SK X |
| 1,475,065 | 11/1923 | Gilbertson | 24/206 B |
| 3,667,805 | 6/1972 | Apri | 24/206 B X |
| 4,011,634 | 3/1977 | Olivieri | 24/70 SK |

FOREIGN PATENT DOCUMENTS

| | | | |
|---|---|---|---|
| 343511 | 6/1978 | Austria . | |
| 2806422 | 8/1978 | Fed. Rep. of Germany | 24/68 SK |
| 2063379 | 7/1975 | France . | |
| 324170 | 8/1975 | France . | |

*Primary Examiner*—Thomas J. Holko

*Attorney, Agent, or Firm*—Kurt Kelman

[57] ABSTRACT

A tensioning lever is mounted on one part of the shoe. A tension loop is mounted on another part of the shoe and adapted to be hooked into the tensioning lever. The tensioning lever can be moved along a rack to tension the fastener and is restrained by releasable means against being pulled back.

Before a retensioning of the fastener, the latter should not be relieved from tension entirely. For this purpose, the tensioning lever cooperates with a ratchet mechanism for tensioning the fastener. The ratchet mechanism comprises a driver which cooperates with the rack and which consists of or is adapted to move with the tensioning lever.

18 Claims, 11 Drawing Figures

Figure 5:
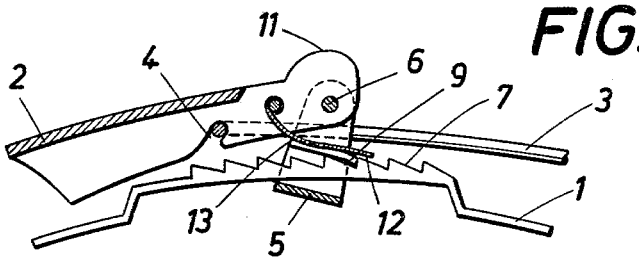

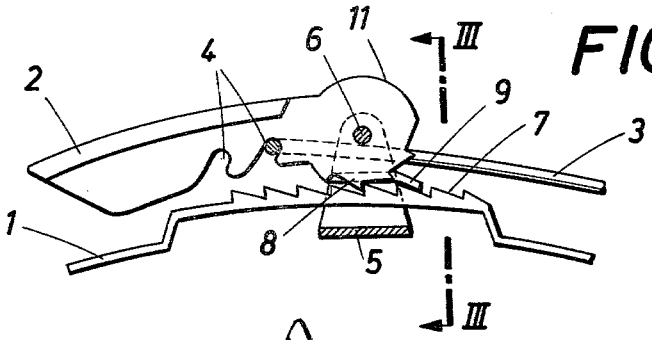
FIG.1
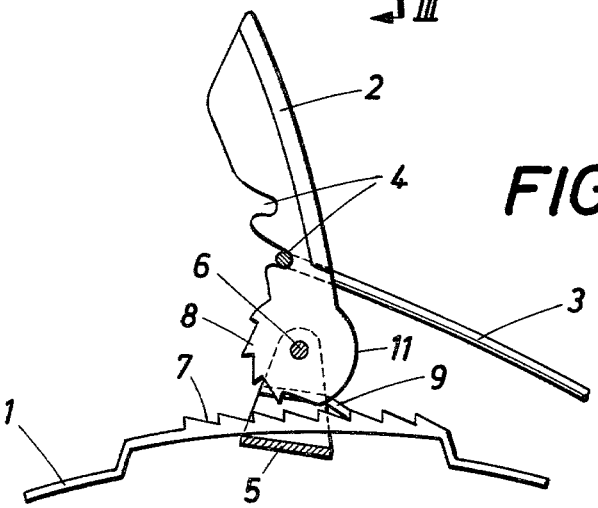
FIG.2
FIG.4
FIG.3
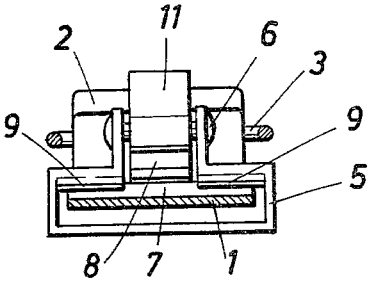
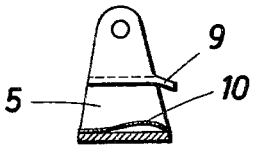

LEVER-OPERABLE FASTENER FOR A SHOE

This invention relates to a lever-operable fastener for a shoe, particularly for a skiing boot, comprising a tensioning lever, which is pivoted to one part of the shoe, and a tension loop, which is attached to another part of the shoe and interengageable with said tensioning lever. Said tensioning lever is adjustable along a rack to tension the belt and is adapted to be restrained by releasable restraining means.

Known lever-operable fasteners of this kind for skiing boots usually comprise a bearing bracket, which is riveted to said one part of the shoe. The tensioning lever is pivoted to said bearing bracket and has a plurality of hooklike recesses for receiving a tension loop, which is pivoted to another part of the shoe. When the tension of the closed fastener is not sufficient, the tension loop must be inserted into a recess which is more remote from the pivotal axis of the tensioning lever. For this operation the fastener must be opened. During the subsequent closing operation the lever arm between the point of engagement of the tension loop and the pivotal axis of the tensioning lever will be larger so that a larger effort is required to close the fastener. It is desired to restrict the effort required to close the fastener, on the one hand, and to adjust the lever-operable fastener within a wide range, on the other hand. To accomplish both objects, it is known to provide a fastener in which the bearing bracket is adjustably mounted on the associated part of the skiing boot. In that case the bearing bracket for the tensioning lever is slidably mounted on a rack, which is secured to the shoe, and the tensioning lever carries a spring-biased locking pawl, which cooperates with the teeth of the rack. That locking pawl usually restrains the bearing bracket against a movement in response to the tension of the fastener. When it is desired to shift the bearing bracket for the tensioning lever, the locking pawl must be lifted against its spring bias and the bearing bracket must be adjusted along the rack by hand. For this reason it is difficult to re-adjust such a known lever-operable fastener, particularly for a person wearing gloves. Besides, the fastener cannot be re-adjusted unless it is relieved from its previous tension.

It is an object of the invention to avoid these disadvantages and so to improve a lever-operable fastener of the kind described first hereinbefore that the fastener in a closed position can be re-adjusted to a higher tension in a simple manner and without a need to relieve the fastener from its previous tension.

This object is accomplished according to the invention in that a ratchet mechanism which is operable by the tensioning lever is provided to adjust the tensioning lever and comprises a driver, which cooperates with the teeth of said rack and is constituted by or movable with the tensioning lever. Because a ratchet mechanism is provided, the tensioning lever can be re-adjusted in steps in one direction to increase the tension of the closed fastener. Depending on the design which is selected, the re-adjusting movement may be effected as the tensioning lever is depressed or raised, because the driver is movable with the tensioning lever. If the tension of the closed fastener is inadequate, it will be sufficient to raise and subsequently depress the tensioning lever in order to increase the tension of the fastener. In this operation, the driver slips on the rack, e.g., as the tensioning lever is raised, and the driver will not interengage with the teeth of the rack until the tensioning lever is depressed. This stepwise increase of the tension of the fastener can be effected by a simple operation of the tensioning lever and permits of a more accurate adjustment of the closed fastener to the desired tension because the pressure applied by the shoe when the fastener is closed is not entirely eliminated. It will be sufficient to raise the tensioning lever through a small angle and this will not greatly change the tension of the tension loop which interengages with the tensioning lever. The tension loop is pivotally moved only near its dead center position and this involves only a small dislocation of the loop in the direction in which tension is applied.

A particularly simple design will be obtained if the tensioning lever is held in a bearing bracket, which constitutes a housing for the ratchet mechanism and which in known manner is slidably guided on the rack. That bearing bracket ensures that the elements of the ratchet mechanism will be in the correct position relative to each other. The slipping of the driver over the teeth of the rack during the swingback of the tensioning lever can be ensured without need for additional structure if the bearing bracket is mounted on the rack with a freedom of movement in the direction of the height of the teeth of the rack and said freedom of movement is sufficient to permit the driver to slip. Owing to said freedom of movement the bearing bracket is forced away to such an extent as the tensioning lever is raised that the driver can then slip over the teeth of the rack but the driver will be forced into the tooth spaces of the rack as the tensioning lever is depressed.

To ensure that the bearing bracket is not moved in the tension-relieving direction under the tensile forces acting on the bearing bracket as the driver slips on the teeth of the rack, it is necessary to provide restraining means. If there is suitable freedom of movement between the bearing bracket and the rack in a direction which is transverse to the longitudinal direction of the rack, the restraining means may simply consist of a detent nose, which cooperates with the teeth of the rack. As the tensioning lever is raised in preparation for a re-adjustment of the tension, the tension loop will force the tensioning lever against the bearing bracket so that the latter under this load is pivotally moved against the rack opposite to the direction in which the bearing bracket is shifted and the detent nose is thus forced into the tooth spaces of the rack. During the tensioning operation of the tensioning lever, the forces acting on the tensioning lever cause the driver to engage the teeth of the rack so that the bearing bracket is advanced in such a direction that the tension of the fastener is increased. Owing to the freedom of movement of the bracket, the detent nose then slides on the teeth.

To ensure that the engagement of the bracket-restraining means does not depend on the tensile force which is exerted by the tension loop on the tensioning lever, a spring may be provided, which is disposed between the rack and the bearing bracket and engages the teeth to act like a detent nose. For this function that spring consists preferably of a leaf spring.

What it is desired to open the lever-operable fastener, the driver and the restraining means must disengage the rack. This can be accomplished in a simple manner in that the tensioning lever has a cam portion, which engages the rack and forces the bearing bracket away from the rack within the range of the freedom of movement of the bearing bracket. That cam portion becomes effective as the tensioning lever is swung back and ensures that the restraining means and the driver will then be pulled out of the tooth spaces of the rack so that the bearing bracket can then be freely shifted in either direction along the rack.

The driver of the ratchet mechanism may be embodied in various forms. In a simple arrangement, the driver may consist of a toothed segment of the tensioning lever. This involves only a low structural expenditure and affords the advantage that the toothed segment may have such a length that it will be automatically pulled out of the tooth spaces of the rack when the tensioning lever has performed a predetermined angular movement.

Alternatively, the driver may consist of a pawl, which consists preferably of a leaf spring and is pivoted to the tensioning lever at a distance from the pivotal axis of the latter and bears resiliently against the rack. Depending on the location of its pivotal axis, the pawl will be pulled over a predetermined number of teeth as the tensioning lever is raised or depressed and during a movement of the tensioning lever in the opposite sense will enter a tooth space so that the tensioning lever is then supported on said rack by said pawl. That support results also in a corresponding advance of the tensioning lever and of its bearing bracket along the rack.

When the pawl has a convex surface facing the rack, said ratchet mechanism can be rendered inoperative in a simple manner in that the tensioning lever is swung back to such an extent that the convex surface of the pawl engages and rolls on the teeth of the rack so that that portion of the pawl which cooperates with the tooth spaces is raised from the teeth and the pawl can then move freely along the teeth.

In another embodiment, the driver consists of a pinion which is coaxial to the tensioning lever and mounted in a housing which contains said rack. The pinion is provided with ratchet teeth on its end face which faces the tensioning lever with ratchet teeth which are arranged to cooperate with oppositely directed, equal ratchet teeth of the tensioning lever to connect said pinion to said lever when the latter is pivotally moved in the tension-increasing sense. On its opposite end face, the pinion is provided with ratchet teeth which are arranged to cooperate with oppositely directed, equal ratchet teeth of the housing to prevent a rotation of the pinion during a swingback of the lever. As the tension lever is depressed, the pinion and the tensioning lever are operatively connected by their cooperating ratchet teeth whereas the pinion is slipping relative to the housing. As a result, the housing and the tensioning lever are shifted along the rack. As the tensioning lever is raised, the cooperating ratchet teeth of the pinion and housing prevent a reverse rotation of the pinion and thus act as restraining means and the pinion is then slipping relative to the tensioning lever.

In another embodiment, the ratchet mechanism comprises a rack which is formed with a slot, which serves to guide the tensioning lever and has side faces formed with mutually oppositely directed, equal ratchet teeth, said tensioning lever has at least two teeth which engage mutually opposite tooth spaces of the said side faces of said slot, and the side faces of said slot are adapted to be resiliently spread apart and/or the teeth of the tension lever are adapted to be resiliently forced toward each other. The teeth of the tensioning lever define alternate pivotal axes for the tensioning lever and that lever tooth which does not define a pivotal axis at a time is moved about the pivotal axis into the next tooth space in the associated side face of the slot. During an angular movement of the tensioning lever in the opposite sense, that advanced tooth then constitutes a pivotal axis and the other lever tooth is shifted to the next tooth space so that the tension of the fastener can be increased by an angular movement of the tensioning lever in opposite directions. To ensure that the teeth of the tensioning lever can move from one tooth space to the next over the intervening tooth, the side faces of the guide slot must be resiliently spread apart or the teeth of the tensioning lever must be resiliently moved toward each other.

To ensure that the tension can be increased in small steps although sufficiently large teeth are provided, the teeth of the side faces of the guide slot may be staggered by one-half of their tooth pitch. In that case the fastener can be tensioned by a movement from tooth to tooth.

To ensure an adequate strength, it may not be desirable to provide two individual teeth, such as two webs or pins. In such case the two teeth may be provided on a guiding member, which constitutes the driver.

When it is desired to open such a lever-operable fastener having a guide slot for the tensioning lever, it is sufficient to impart a pivotal movement to the two teeth of the tensioning lever so that their connecting plane approaches the direction of the guide slot by a suitable angular movement of the tensioning lever until the two teeth are disengaged from the toothed side faces of the guide slot. If the two teeth are provided on a common guiding member, the latter may have suitably curved guiding surfaces which after a suitable angular movement of the guiding member permit the guiding member to slip on the toothed sides of the slot.

Figure 6:
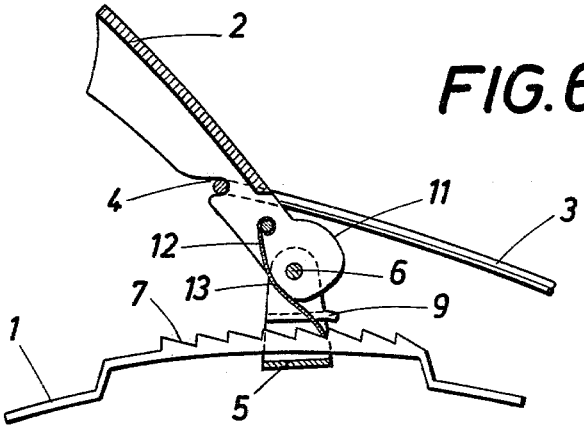
Figure 7:
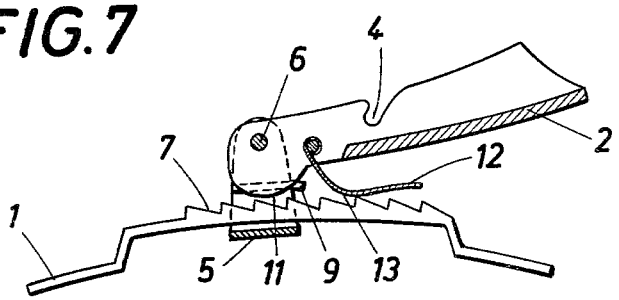
Figure 8:
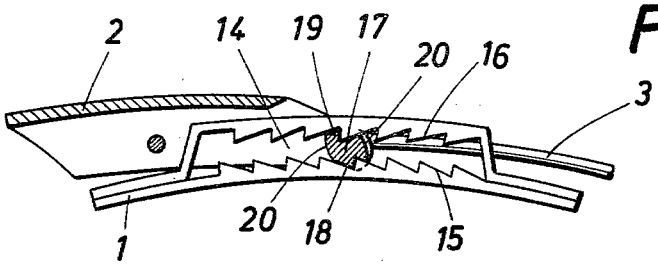
Figure 9:
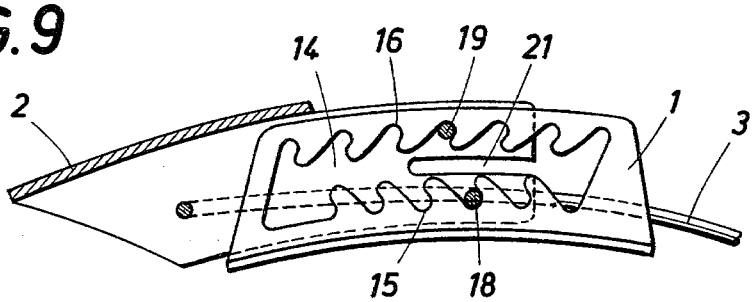
Figure 11:
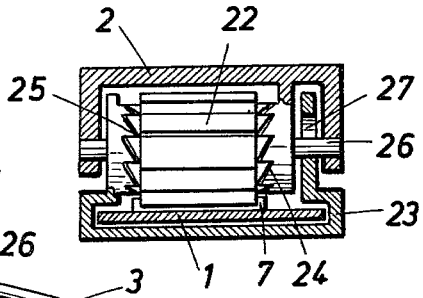
Figure 10:
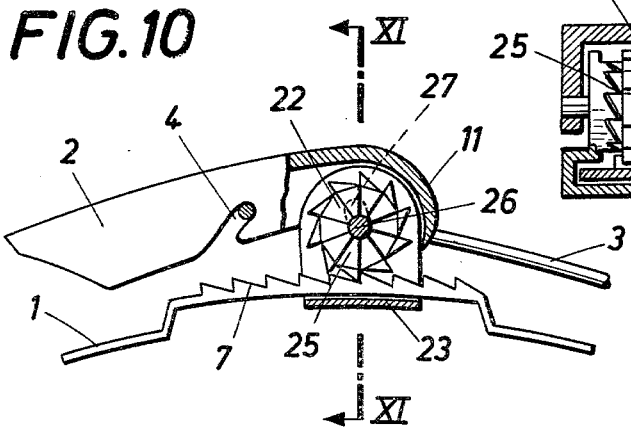

The subject matter according to the invention is shown by way of example on the drawing, in which FIGS. 1 and 2 are side elevations, partly in section, and show a lever-operable fastener according to the invention in two different closed positions, FIG. 3 is a sectional view taken on line III—III in FIG. 1, FIG. 4 is a sectional view showing a bearing bracket for a tensioning lever, FIGS. 5 to 7 are side elevations, partly torn open, and show a modified lever-operable fastener according to the invention in three different closed positions, FIG. 8 is a longitudinal sectional view showing a lever-operable fastener having a slot for guiding the tensioning lever, FIG. 9 is another longitudinal sectional view showing a modification of the lever-operable fastener of FIG. 8, FIG. 10 is a side elevation, partly torn open, and shows another modification of a lever-operable fastener according to the invention, and FIG. 11 is a sectional view taken on line XI—XI in FIG. 10.

The lever-operable fasteners shown in the drawings comprise basically a rack 1, which is secured to one part of a shoe, which is not shown, and a tensioning lever 2, which is associated with the rack 1 and cooperates with a tension loop 3, which is hinged to another part of the shoe. The tension loop 3 may be inserted into hook-shaped recesses 4 of the tensioning lever 2 or may be hinged to the tensioning lever 2, as is indicated in FIGS. 8 and 9.

In the embodiment shown by way of example in FIGS. 1 to 4, the tensioning lever 2 is pivoted in a bearing bracket 5 on a pivot 6 and has a toothed segment 8, which cooperates with the racket teeth 7 of the rack 1 and constitutes a driver of a ratchet mechanism comprised of the toothed segment 8 and the rack 1. The bearing bracket 5 constitutes a housing for said ratchet mechanism and surrounds the rack 1 with a freedom of movement in the direction of the height of the teeth 7. The bearing bracket 5 is provided with lateral detent noses 9, which cooperate with the teeth 7 and may be replaced by corresponding lugs or ribs. The detent noses 9 restrain the bracket 5 against a movement in a tension-relieving sense.

When the tensioning lever 2 is raised from the position shown in FIG. 1 in which the fastener is closed to the position shown in FIG. 2, the freedom of movement between the bearing bracket 5 and the rack 1 permits the tensioning lever 2 to slip on the teeth of the rack 1. Owing to the pulling face exerted by the tension loop 3 on the tensioning lever 2, the bearing bracket 5 is subjected during this operation to a torque tending to force the detent noses 9 against the teeth 7, as is indicated in FIG. 2, so that the bearing bracket 5 is restrained against being pulled back. When the tensioning lever 2 after its swingback is swung to the position shown in FIG. 1, the toothed segment is first forced against the teeth 7 so that the pivotal movement of the tensioning lever 2 will cause the toothed segment 8 to roll on the teeth 7 of the rack 1 in the tensioning sense and the bearing bracket 5 is pulled along by means of the pivot 6 for the tensioning lever 2. In this operation the freedom of movement between the bearing bracket and the rack 1 in the direction of the height of the teeth 7 permits the detent noses 9 to slip on the teeth 7. To ensure that the detent noses 9 will interengage with the teeth 7 as the tensioning lever is swung back in preparation for a retensioning operation, a suitable spring 10 may be provided between the rack 1 and the bearing bracket 5, as is indicated in FIG. 4.

The tension of the lever-operable fastener can be increased in steps merely by a repeated raising and depressing of the tensioning lever 2. When it is desired to open the fastener, the restraint provided by the detent noses 9 must be eliminated and the ratchet mechanism must be disabled. For this purpose the tensioning lever 2 is provided near the toothed segment 8 with a cam portion 11, which in response to a sufficiently wide swingback of the tensioning lever 2 bears on the teeth 7 of the rack 1 and forces the bearing bracket 5 away from the rack 1 to an extent permitted by the freedom of movement. As a result, the detent noses 9 are also pulled out of the tooth spaces. In this position of the tensioning lever, neither the detent noses 9 nor the toothed segment 8 cooperate with the teeth 7 so that the tensioning lever 2 and its bearing bracket 5 are freely slidable on the rack 1.

The embodiment of the lever-operable fastener shown in FIGS. 5 to 7 differs from the lever-operable fastener shown in FIGS. 1 to 4 only in that the driver for the ratchet mechanism consists of a pawl 12, which is pivoted to the tensioning lever 2, rather than a toothed segment of the tensioning lever 2. The pawl 12 is pivoted to the tensioning lever 2 on an axis which is spaced from the pivot 6. The pawl 12 is resiliently urged against the ratchet teeth 7 of the rack 1. For this purpose the pawl 12 consists of a suitably mounted leaf spring.

As the tensioning lever 2 is raised from the position shown in FIG. 5 to the position shown in FIG. 6, the pawl 12 is advanced over the teeth 7 of the rack 1 because the detent noses 9 restrain the bearing bracket 5 against being pulled back. As the tensioning lever 2 is subsequently depressed, the pawl is forced into that tooth space of the rack 1 to which the pawl has previously been advanced. Thereafter the tensioning lever 2 cannot be depressed unless it is advanced at the same time. It is apparent that the fastener can be automatically retensioned by a repeated depression of the tensioning lever 2 because the latter is supported by the pawl 12.

FIG. 7 shows the fastener in its open position, which is assumed when the tensioning lever is raised beyond the position shown in FIG. 6. In that case the pivot of the pawl 12 is moved beyond the apex of the circular path and back toward the rack 1 so that the bearing bracket 5 is advanced. This advance of the bearing bracket in the tension-increasing direction will have no effect because the tension loop 3 is relieved by the swingback of the tensioning lever 2. On the other hand, the descent of the pawl 12 into the teeth 7 causes the convex surface 13 of the pawl to face and engage the teeth 7 so that the end portion of the pawl is disengaged from the teeth 7. The bearing bracket and the tensioning lever are now freely slidable.

The pivot for the pawl may be located in such a position that the pawl is forced into a tooth space as the tensioning lever is raised so that the fastener will then be retensioned whereas the tensioning lever performs an idle movement as it is depressed.

In the embodiment shown in FIG. 8, the rack 1 has a guide slot 14, the side faces 15 and 16 of which are formed with mutually oppositely directed, equal ratchet teeth. A guiding portion 17 of the tensioning lever 2 extends into said guide slot 2 and has pivot teeth 18 and 19, which cooperate with the teeth of the side faces 15 and 16 of the slot 14. The rack 1 consists of two parts so that the toothed side faces 15 and 16 can be resiliently spread apart. As the tensioning lever 2 is raised when the fastener is in its closed position, the pivotal axis of the fastener is provided by the tooth 19, which is disposed in a tooth space of the side face 16 of the guide slot 14. At the same time, the opposite tooth 18 spreads the side faces 15 and 16 apart and then falls into the next following tooth space in the side face 15. As the tensioning lever 2 is then depressed, it is turned about the tooth 18 and the tooth 19 is advanced over the next tooth of the side face 16. It is apparent that such ratchet mechanism also permits a stepwise tensioning of the fastener by means of the tensioning lever 2. When it is desired to open the fastener, it is sufficient to swing the tensioning lever until the convex sliding surfaces 20 of the guiding portion 17 face the toothed side faces 15 and 16 so that the teeth 18 and 19 are disengaged and cannot prevent a displacement of the tensioning lever 2.

The embodiment shown in FIG. 9 differs somewhat from the design shown in FIG. 8 in that the teeth 18 and 19 which cooperate with the toothed side faces 15 and 16 of the guide slot 14 consist of individual pins and that portion of the tensioning lever which carries the teeth 18 and 19 is formed with a longitudinal slot 21, which extends between the teeth 18 and 19 so that the latter can be resiliently forced against each other. In this case the rack 1 need not be resilient.

In the embodiment shown in FIGS. 10 and 11, the driver consists of a separate pinion 22, which is mounted in a housing 23 for rotation on the pivotal axis of the tensioning lever 2. The housing 23 surrounds the rack 1 and is held by the latter against a rotation about said pivotal axis. This embodiment is unique in that the pinion 22 is provided on each end face with ratchet teeth 24 or 25. The ratchet teeth 24 on one end face can cooperate with mating ratchet teeth of the tensioning lever 2 to move the latter in the tensioning direction. The ratchet teeth 25 on the other end face of the pinion 22 can cooperate with mating ratchet teeth of the housing 23 to prevent a rotation of the pinion 23 relative to the housing 23 in the tension-relieving sense. As the tensioning lever 2 is raised, the housing 23 holds the pinion 22 against rotation so that the pinion in mesh with the teeth 7 of the rack 1 prevents a movement of the housing. As the tensioning lever 2 is turned in a tensioning sense, the pinion 22 follows the movement in the tensioning sense whereas the teeth 25 slip on the housing. The pinion 22 then rolls on the rack 1 and carries the housing 23 along so that the fastener will be tensioned. Because the pinion 22 remains always in mesh with teeth 7 of the rack 1 during the tensioning movement, that mesh must be eliminated when the fastener is to be opened. This can be accomplished in a simple manner in that the pinion is pulled out of the teeth 7 of the rack 1 by the tensioning lever 2. For this purpose the lever 2 and the pinion 22 are mounted on a common shaft 26, which extends into a suitable slot 27 of the housing 23.

What is claimed is:

1. A lever-operable fastener for a shoe, comprising a rack formed with rack teeth and adapted to be attached to one part of said shoe, a lever mount mounted on said rack and movable along the same and defining a pivotal axis, a tension lever connected to said lever mount and pivotally movable about said pivotal axis, a tension loop adapted to be attached to another part of said shoe and interengageable with said tension lever and adapted to be tensioned by a movement of said lever mount along said rack in a predetermined direction, a ratchet mechanism comprising driver means carried by said lever mount and movable in unison with said tension lever and arranged to cooperate with said rack teeth during a pivotal movement of said tension lever in a predetermined sense to move said lever mount along said rack in said predetermined direction, and releasable means arranged to restrain said lever mount against a movement along said rack opposite to said predetermined direction during a pivotal movement of said tension lever opposite to said predetermined sense.

2. A fastener as set forth in claim 1, in which said driver means are integral with said tension lever.

3. A fastener as set forth in claim 1, in which said driver means are connected to said tension lever.

4. A fastener as set forth in claim 1, in which said lever mount comprises a bearing bracket, which carries said driver means.

5. A fastener as set forth in claim 4, in which said bearing bracket is mounted on said rack with a freedom of movement in the direction of the height of said rack teeth and said rack teeth comprise ratchet teeth in said ratchet mechanism and permitting said driver means to slip on said rack teeth during a pivotal movement of said tension lever opposite to said predetermined sense.

6. A fastener as set forth in claim 5, in which said restraining means comprises a detent nose carried by said bracket and adapted to cooperate with said rack teeth.

7. A fastener as set forth in claim 6, in which said detent nose consists of a spring, which tends to interengage with said rack teeth.

8. A fastener as set forth in claim 5, in which said tension lever comprises a cam portion which in response to a pivotal movement of said tension lever opposite to said predetermined sense is arranged to bear on said rack and to urge said driver means away from said rack within the extent of said freedom of movement of said bracket in response to a pivotal movement of said tension lever opposite to said predetermined sense.

9. A fastener as set forth in claim 1, in which said driver means comprises a toothed segment of said tension lever and said rack teeth comprise ratchet teeth in said ratchet mechanism and permitting said toothed segment to slip on said rack teeth during a pivotal movement of said tension lever opposite to said predetermined sense.

10. A fastener as set forth in claim 1, in which said driver means consists of a pawl, which is pivoted to said tension lever on an axis spaced from said pivotal axis and said rack teeth are ratchet teeth permitting said pawl to slip on said rack teeth during a pivotal movement of said tension lever opposite to said predetermined sense.

11. A fastener as set forth in claim 10, in which said pawl consists of a leaf spring.

12. A fastener as set forth in claim 10, in which said pawl has a convex portion facing said rack teeth.

13. A fastener as set forth in claim 1, in which said lever mount comprises a housing which surrounds said rack, said driver means comprise a pinion which is rotatably mounted in said housing on said pivotal axis and in mesh with said rack teeth, said pinion has a first end face facing said lever and formed with a first set of ratchet teeth, said tension lever is formed with a second set of ratchet teeth, said first and second sets of ratchet teeth comprise in said ratchet mechanism and are arranged to mesh with each other during a pivotal movement of said tension lever in said predetermined sense so as to move said housing along said rack in said predetermined direction, and to slip on each other during a pivotal movement of said tension lever opposite to said predetermined sense, and said pinion has a second end face facing away from said tension lever and facing said housing, and said restraining means comprise a third set of ratchet teeth formed on said second end face and a fourth set of ratchet teeth which are carried by said housing and are arranged to mesh with said third set of ratchet teeth during a pivotal movement of said tension lever opposite to said predetermined sense to prevent a rotation of said pinion and thus to restrain said housing against a movement along said rack opposite to said predetermined direction, and said third and fourth sets of ratchet teeth are arranged to slip on each other during a pivotal movement of said tension lever in said predetermined sense.

14. A fastener as set forth in claim 1, in which said rack defines a slot extending in the longitudinal direction of said rack and having side faces formed with oppositely directed, equal ratchet teeth which define tooth spaces between them and constitute said rack teeth, said lever mount comprises two detent teeth, which are carried by said tension lever and extend into mutually opposite tooth spaces in said side faces, at least one of said rack and lever mount being resilient to permit each of said pivot teeth to move along the adjacent side face of said slot from one tooth space thereof into another during a pivotal movement of said tension lever when the other of said pivot teeth engages the opposite side face in one of said tooth spaces thereof, one of said detent teeth and the ratchet teeth cooperating with it constitute said ratchet mechanism, and the other of said detent teeth and the ratchet teeth cooperating with it constitute said restraining means, said one detent tooth is arranged to define a pivotal axis for a pivotal movement of said tension lever opposite to said predetermined sense, and said other detent tooth is arranged to define a pivotal axis for a pivotal movement of said tension lever in said predetermined sense.

15. A fastener as set forth in claim 14, in which said rack is resilient and permits said side faces to be resiliently spread apart.

16. A fastener as set forth in claim 14, in which said lever mount is resilient and permits said pivot teeth to be forced toward each other.

17. A fastener as set forth in claim 14, in which said ratchet teeth of said side faces are staggered by one-half tooth pitch.

18. A fastener as set forth in claim 14, in which said lever mount comprises a guide portion which is carried by said tension lever and carries said pivot teeth and has convex surfaces disposed between said pivot teeth and said tension lever is pivotally movable opposite to said predetermined sense to disengage said pivot teeth from said side faces and cause said convex surfaces to engage said side faces.

* * * * *